US005772356A

United States Patent [19]

Collins

[11] Patent Number: 5,772,356

[45] Date of Patent: Jun. 30, 1998

[54] ADJUSTABLE COLUMN CONNECTOR APPARATUS

[76] Inventor: Samuel W. Collins, 1028 Robertson Way, Sacramento, Calif. 95818

[21] Appl. No.: 804,340

[22] Filed: Feb. 21, 1997

[51] Int. Cl.[6] ..... B25G 3/00

[52] U.S. Cl. ..... 403/343; 403/299; 403/353; 248/188.4; 52/126.1

[58] Field of Search ..... 403/299, 307, 403/300, 353, 342, 343, 260, 258, 256, 19, 44; 248/188.4, 222.41; 52/126.6, 126.5, 126.1

[56] References Cited

U.S. PATENT DOCUMENTS

| | | | |
|---|---|---|---|
| 831,597 | 9/1906 | Bowman | 403/44 X |
| 3,222,030 | 12/1965 | Thorpe | 52/126.6 |
| 3,398,933 | 8/1968 | Haroldson | 52/126.6 X |
| 3,470,663 | 10/1969 | Tate | 52/126.6 |
| 4,780,571 | 10/1988 | Huang | 52/126.6 X |
| 4,996,804 | 3/1991 | Naka et al. | 52/126.6 |
| 5,116,004 | 5/1992 | Luecke | 248/188.4 X |
| 5,333,423 | 8/1994 | Propst | 52/126.6 |

FOREIGN PATENT DOCUMENTS 5-331995A 12/1993 Japan .

490587 6/1970 Switzerland .

OTHER PUBLICATIONS

Fypon Molded Millwork Balustrade Systems Polymer Steel Columns and Posts, Stewartstown, Pennsylvania, Jan., 1997.

*Primary Examiner*—Kenneth J. Dorner
*Assistant Examiner*—William L. Miller
*Attorney, Agent, or Firm*—Hall & Kerr

[57] ABSTRACT

An adjustable column connector apparatus which provides for quick, easy and accurate installation of columns during building construction. The apparatus includes an inner connector member with a threaded socket, and an outer member with a corresponding threaded body which mates with the threaded socket. The inner connector member is attached to a column end by screws. The threaded body is engaged in the threaded socket, and the outer connector member is rotatably attached to an adjacent structure by a lag which slidably fits within a slot in the outer connector member. The outer connector member is rotated relative to the inner connector member to advance or retract the threaded body within the threaded socket and correspondingly draw down or push away the adjacent structure relative to the column end.

9 Claims, 5 Drawing Sheets

ADJUSTABLE COLUMN CONNECTOR APPARATUS

BACKGROUND OF THE INVENTION

1. Field of the Invention

The present invention pertains generally to devices and methods for positioning and installing columns, posts, pillars, and other vertical support members during building construction. More particularly, the present invention is an adjustable column connector apparatus which provides for quick, easy, secure, and adjustable joining of columns to various structures.

2. Description of the Background Art

Several types of columns, pillars, and other vertical support members are used in residential, commercial, and other building construction. Such columns are typically made of wood, steel, fiberglass-reinforced resin, or combinations of these materials. Columns frequently act as load bearing members for parts of buildings to support beams, trusses or other building members, as well as serve a decorative function such as ornamental pillars on the front porch of a residence.

The correct vertical positioning of columns during construction and subsequent holding of columns in place is important to the structural integrity of buildings. If a column is positioned and secured such that the top of a column is too low relative to the structure above it or otherwise is not properly supporting the structure, the overhead structure will sag until it rests on the column. Correction of improperly positioned columns and damaged structures is generally difficult, time consuming and expensive.

In many buildings, columns are held in place merely by the weight of the structure above the columns. In other situations, the columns are nailed in place or screws or steel or wooden dowels are used to aid in holding the columns in place. In each of these cases, however, the columns generally are not adequately connected to the supported structure and are prone to unwanted lateral movement due to storms, earthquakes or other disturbances which can result in structural damage and unsafe building conditions. Particularly, in areas subjected to high winds and hurricanes, overhead porch structures on residential buildings undergo "uplift" or upward movement relative to columns supporting the structures. Further, the use of nails, screws or dowels does not provide for vertical adjustment of columns relative to the supported structure.

A base anchor device is known for supporting columns and pillars which are made of metal pipe. The base anchors comprise a metal base which inserts into the top and/or bottom of a steel pipe column and which attaches to the column by screws. The base anchors are then joined to the structures above and/or below the column by screws or other hardware. These devices are deficient in that the load placed upon the screws holding the column to the base anchor can cause the screws to shear or strip and leave the column unsecured. Additionally, the currently available base anchor device do not provide for any vertical adjustment of the column during installation. Still another drawback of currently used base anchor devices is that they are only suitable for metal pipe columns, and cannot be readily adapted to wood or fiberglass reinforced resin columns.

The use of metal straps and hold-downs on columns to prevent structural uplift due to high winds is also known. The metal straps include perforations for nails and bolts so that the straps can be nailed or screwed in place. The accurate placing of metal straps, however, tends to be difficult and time consuming, and the straps can only be used with hollow columns having a sufficiently large diameter to accommodate the hold-downs and straps. Further, the straps cannot be completely secured or tightened, and still rely on the load upon the columns to hold the columns in place. As with base anchors, strap devices do not allow vertical adjustment of column height, and thus a column using such devices can end up being positioned too low or too high relative to the structure above the column, which can ultimately cause sagging and damage to the structure. Presently, no devices or methods are available for use with columns or other vertical supports which can be accurately, securely and adjustably positioned on columns in order to support overhead structures.

Accordingly, there is a need for an adjustable column connector apparatus which provides for vertical adjustment of columns relative to a supported structure, which can be used with all types of column materials, which does not rely on the weight of the supported structure to hold columns in place, and which is quick and easy to use and install. The present invention satisfies these needs, as well as others, and generally overcomes the deficiencies found in the background art.

SUMMARY OF THE INVENTION

The present invention is an adjustable column connector apparatus which provides for quick and easy attachment of columns to structures, and which provides for accurate vertical positional adjustment of the column relative to structures supported by the columns. The invention greatly reduces the time and expense currently required for installation of columns in buildings. In general terms, the invention comprises a first, inner connector member, a second, outer connector member, and threaded means for positionally adjusting the inner and outer connector members relative to each other. The inner connector member includes means for attaching to a column. The outer connector member includes a first coupling means for rotatably attaching to an external structure, and a second coupling means for fixedly attaching to an external structure. The threaded positional adjustment means preferably comprises an externally threaded body on the outer connector member and an internally threaded socket or receiver on the inner connector member. Alternatively, the threaded body may be located on the inner connector member, while the threaded socket is included on the outer connector member. By engaging the threaded body within the threaded socket, and rotating the outer connector relative to the inner connector member to advance or retract the threaded body within the threaded socket, the inner and outer connector members, together with the attached column and adjacent structure, can undergo quick, easy and accurate positional adjustment.

By way of example, and not of limitation, the inner connector member preferably comprises an annular flange which is structured and configured to match the annular end of a column. The threaded socket is joined to the flange along an inner edge thereof. Gussets or reinforcing plates may be included around the outer circumference of the of the threaded socket and a lower surface of the annular flange. A plurality of holes in the flange provide means for coupling the flange to a column by screws, bolts or like hardware. The outer connector member preferably comprises a top plate, with the threaded body centrally positioned on a lower surface of the top plate. A rotation slot in the top plate provides for rotatable attachment of the top upper connector member to a lag or other hardware on a structure to be supported by a column. A plurality of holes in the top plate allow the upper connector member to be firmly affixed to a supported structure. Preferably, a plurality of lateral openings are included in the threaded body to provide access to an adjustment tool. The adjustment tool, which may be a screw driver, Allen wrench, or simple metal rod, acts as a lever to provide sufficient force for turning the outer connector member relative to the inner connector member.

The invention is used by coupling the inner connector member to the end of a column by inserting screws or other fastening hardware through the holes provided on the flange of the inner connector member, and engaging the screws into the material of the column. The threaded socket of the inner connector member fits within the bore of the column. The threaded body of the outer connector member is engaged in the threaded socket of the inner connector member, and is positionally adjusted by rotating the outer connector member relative to the inner connector member, which allows the inner and outer connector members to draw together or spread apart as the threaded body moves within the threaded socket. The outer connector member is rotatably joined to an external structure or object adjacent the column, such as a beam or truss, by attaching a bolt or lag to the external structure, and then slipping the lag into the rotation slot in the top plate of the outer connector member. The inner and outer connector members are positionally adjusted by rotating the upper connector member relative to the lower connector member, so that the threaded body advances into or retracts out of the threaded socket. Generally, an adjustment tool is inserted into the laterally facing holes in the threaded body to act as a lever and aid in the rotation of the outer connector member. As the inner and outer connector members are positionally adjusted, the attached column and adjacent structure are moved apart or drawn together, depending upon the direction of rotation, quickly, easily and precisely into a desired position. Once the desired positional relationship of the column and external structure has been thus obtained, the outer connector member is securely affixed to the external structure by means of screws or bolts through the holes in the top plate of the outer connector member. Since the adjustable column connector apparatus of the invention may be subjected to substantial loads, the inner and outer connector members are preferably fabricated from steel or other high strength metal alloy. A decorative collar can be placed over the adjustable column connector apparatus to enhance the aesthetic appearance of the installed column.

The adjustable column connector apparatus comprising the invention may be used with all types of conventional columns, pillars, and vertical supports, including columns and pillars made of wood, stone, fiberglass-reinforced resin, metal, or combinations of these materials. The inner connector member can be an integral portion of the column end, with the threaded socket comprising internal threading in the bore of the column. The invention is preferably used on the top end of a column adjacent to the structure supported by the column, but may alternatively be positioned at the bottom of the column, or at the top and the bottom of a column. Use of the invention provides a method for both drawing down and pushing up on a structure supported by the column in order to optimize the support provided by the column to the structure over the column. The "draw-down" operation provided by the invention is particularly useful for correction of "sprung" trusses (risen in position relative to adjacent trusses) during building construction.

The method provided by the invention generally comprises the steps of affixing an inner connector member to the end of a column, engaging a threaded body on the outer connector member with a threaded socket on the inner connector member, rotatably attaching the outer connector member to an external structure, rotating the outer member relative to the inner member to positionally adjust the inner and outer connector members, and fixedly coupling the outer connector member to the external structure.

An object of the invention is to provide an adjustable column connector apparatus which allows quick, easy and accurate positional adjustment of a column relative to a structure supported by the column.

Another object of the invention is to provide an adjustable column connector apparatus which allows a column to be optimally positioned to support a load positioned over the column.

Another object of the invention is to provide an adjustable column connector apparatus which can be rotatably attached to an overhead structure and then turned to draw down the overhead structure towards the column.

Another object of the invention is to provide an adjustable column connector apparatus which allows for correction of sprung trusses during building construction.

Another object of the invention is to provide an adjustable column connector apparatus which can be used with all types of conventional columns, pillars and vertical supports.

Another object of the invention is to provide an adjustable column connector apparatus which firmly holds a column in place and can resist lateral forces placed on the column which could otherwise cause unwanted movement of the column.

Another object of the invention is to provide an adjustable column connector apparatus which increases the structural integrity of buildings and enhances building safety.

Another object of the invention is to provide an adjustable column connector apparatus which prevents damage to porch structures on buildings caused by uplift due to high winds.

Another object of the invention is to provide an adjustable column connector apparatus which reduces the time and cost of installing columns in buildings.

Further objects and advantages of the invention will be brought out in the following portions of the specification, wherein the detailed description is for the purpose of fully disclosing the preferred embodiment of the invention without placing limitations thereon.

BRIEF DESCRIPTION OF THE DRAWINGS

The present invention will be more fully understood by reference to the following drawings, which are for illustrative purposes only.

DETAILED DESCRIPTION OF THE PREFERRED EMBODIMENTS

Figure 1:
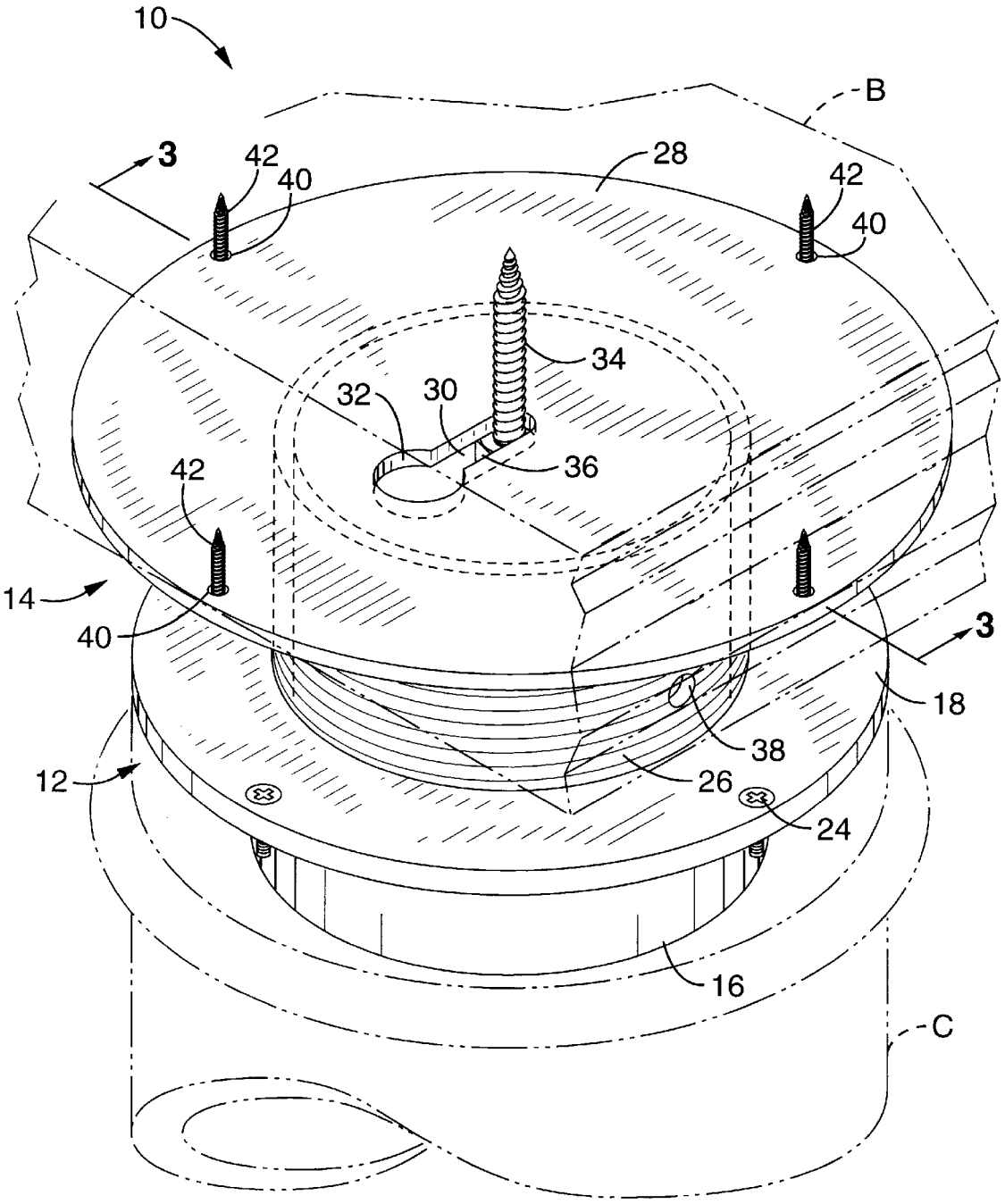
FIG. 1 is a perspective view of an adjustable column connector apparatus in accordance with the present invention, shown together with a column and a beam adjacent the column.
Figure 2A:
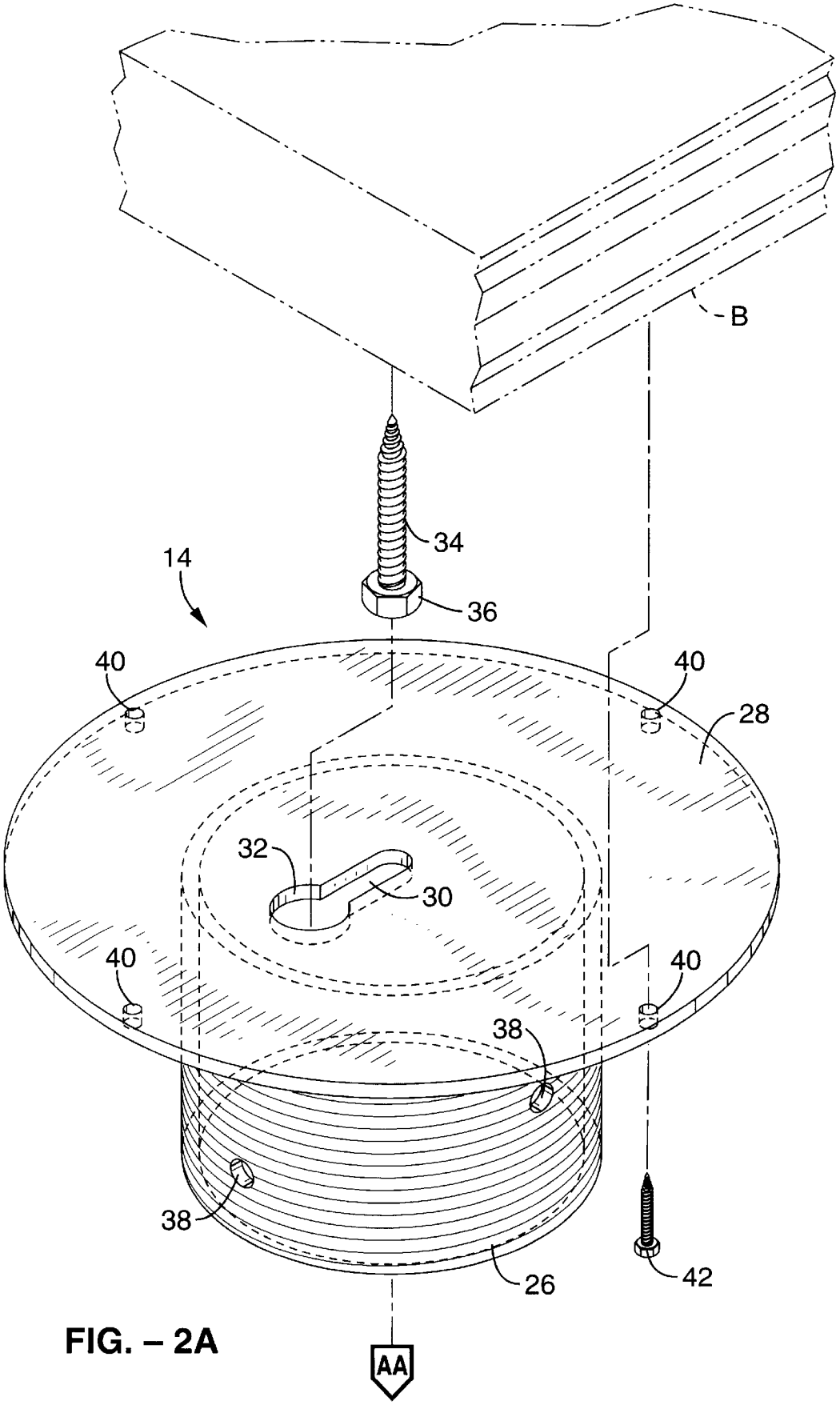
FIG. 2A and FIG. 2B are an exploded view of the assembly shown in FIG. 1.
Figure 2B:
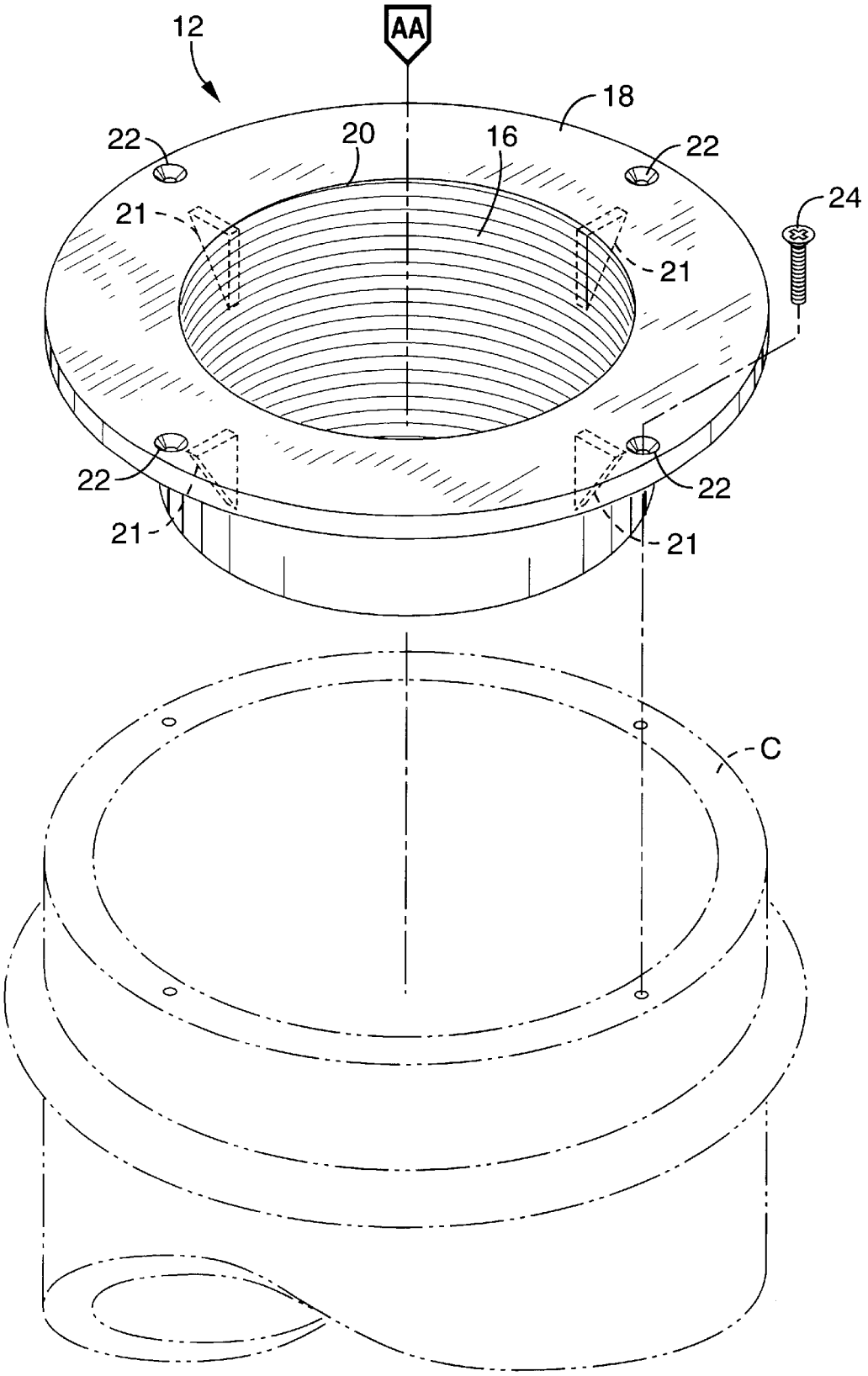
Figure 3:
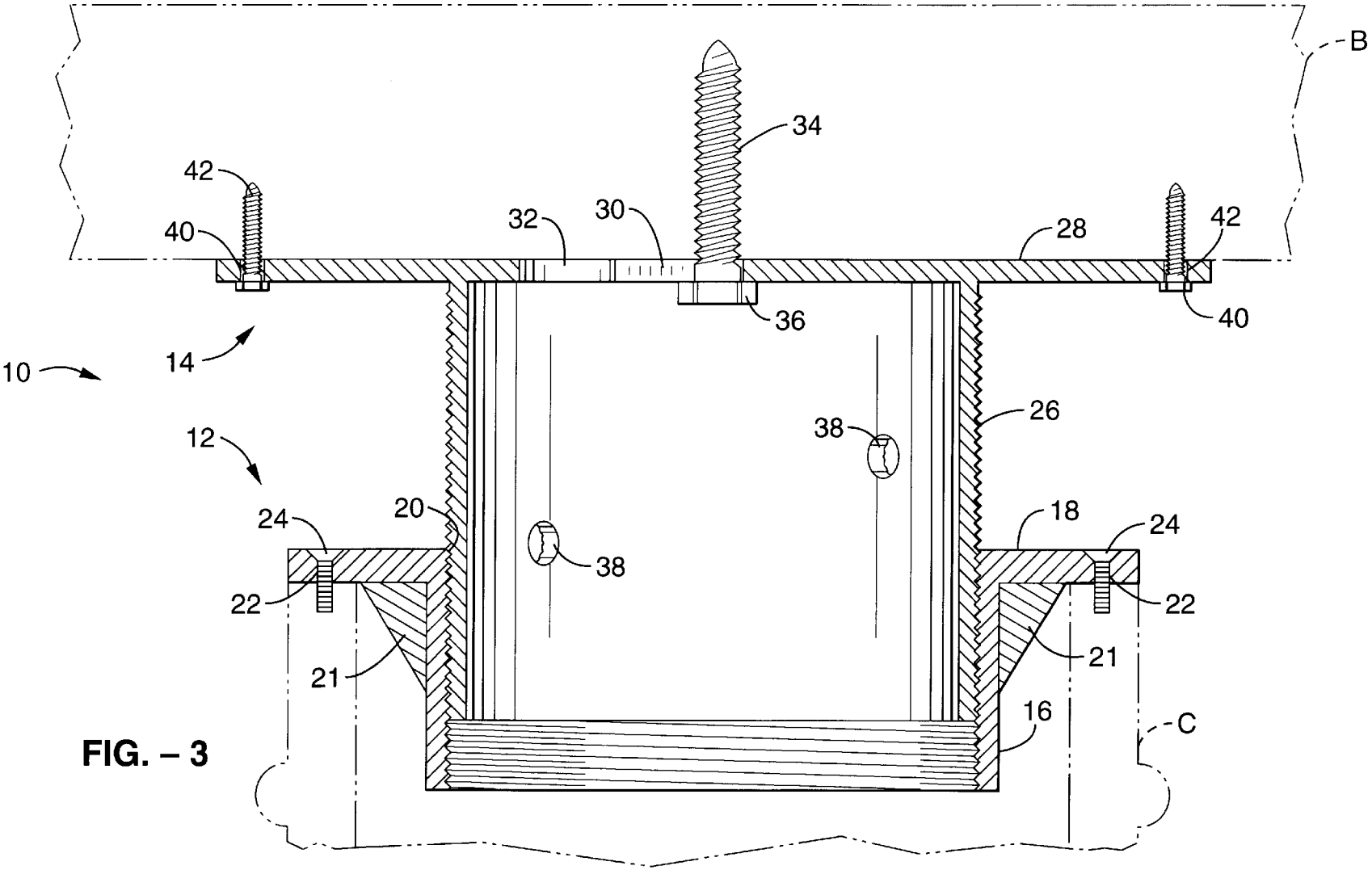
FIG. 3 is a cross-sectional view of the assembly of FIG. 1, shown through line 3—3.
Figure 4:
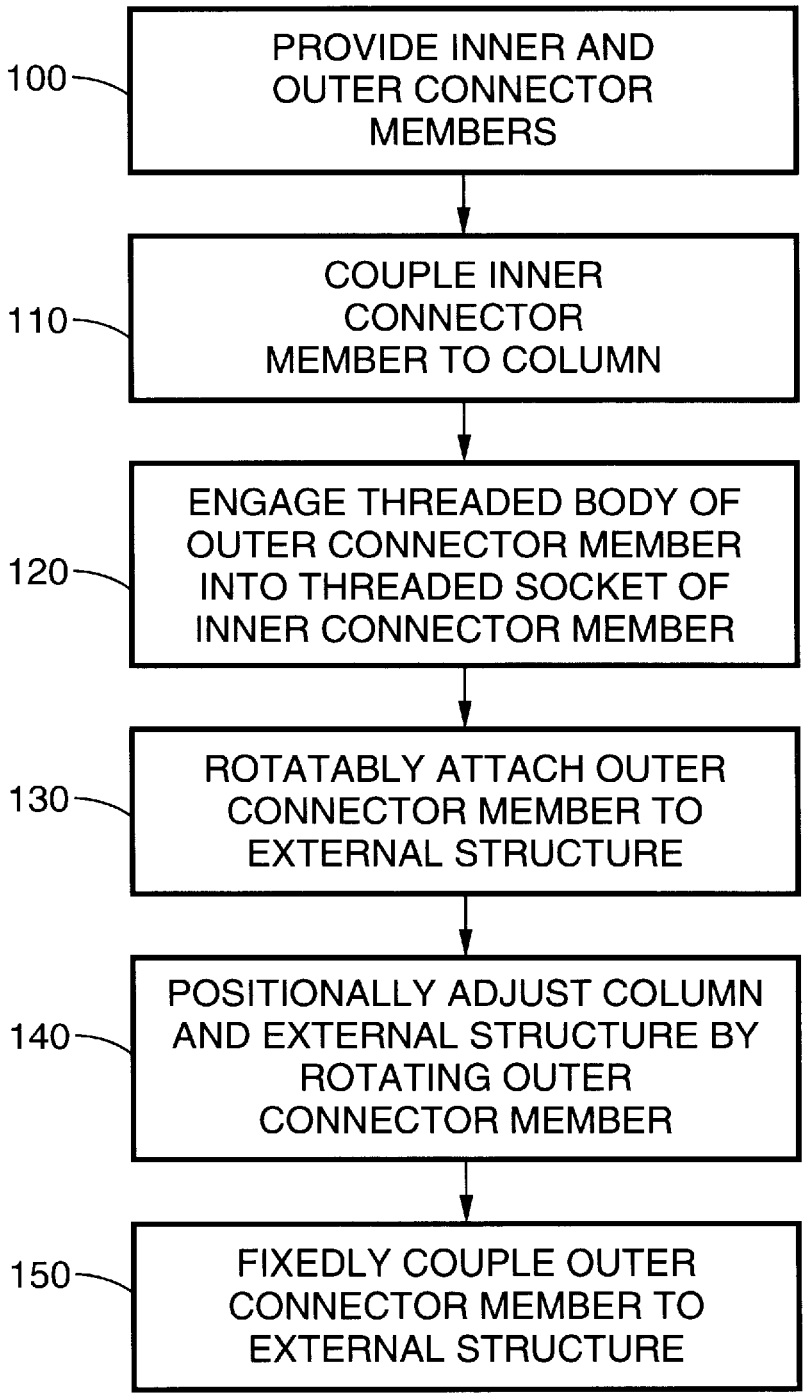
FIG. 4 is a flow chart showing generally the steps of the method comprising the invention.

Referring more specifically to the drawings, for illustrative purposes the present invention is embodied in the apparatus shown FIG. 1 through FIG. 3, and the method outlined in FIG. 4. It will be appreciated that the apparatus may vary as to configuration and as to details of the parts, and that the method may vary as to details and the order of the steps, without departing from the basic concepts as disclosed herein. The invention is disclosed generally in terms of building construction, although numerous other uses for the invention, wherein positional adjustment of a vertical support relative to an object is required, will suggest themselves to persons of ordinary skill in the art. The invention is also disclosed generally in terms of use on the top end of a column. It should be readily understood, however, that the adjustable column connector apparatus comprising the invention may be used at the top and/or bottom end of a column. The term "column" as used in this disclosure should be understood as referring to vertical support members generally, including columns, pillars, pilings, pipes, posts and like vertical support members which can be used to support an object or structure.

Referring first to FIG. 1 through FIG. 3, an adjustable column connector apparatus 10 in accordance with the present invention is generally shown. The adjustable column connector apparatus 10 comprises a first, inner connector member 12 for attaching to a column C, and a second, outer connector member 14 which attaches to an external structure or object such as beam B which is adjacent to column C.

Threaded means for positionally adjusting inner and outer connector members 12, 14 relative to each other are included with the invention. The threaded positional adjustment means preferably comprises a generally cylindrical, internally threaded socket or receiver 16, which is coupled to a flange 18, preferably along inner edge 20 of a flange 18 on inner connector member 12. Flange 18 is preferably annular in shape, and is structured and configured to match the cross-sectional shape of conventional columns. Flange 18 may be varied in size and shape as required for use with different column sizes and shapes. A plurality of reinforcing gussets 21 are included along the junction of flange 18 and threaded socket 16. Means for coupling inner connector member 12 to column C are included on inner connector member 12, preferably in the form of a plurality of fastening holes or bores 22 in flange 18 which are structure and configured to receive a corresponding plurality of screws 24 or like fastening hardware. Other conventional coupling means may alternatively be used to attach inner connector member 12 to column C. For example, when using metal pipes for columns, threaded socket 16 can be attached within the end of the pipe by means of welding, or internal threading can be included directly on the pipe end to form the threaded socket 16.

The threaded positional adjustment means also preferably comprises a generally cylindrical, externally threaded body 26 on outer connector member 14 which is structured and configured to engage threaded socket 16 on inner connector member 12. Outer connector member 14 preferably includes a top plate 28 which is coupled to threaded body 26. Means for rotatably attaching outer connecting member 14 to beam B are included on outer connecting member 14, and preferably comprise a rotation slot 30 in top plate 28, a hole 32 in top plate 28 which communicates with slot 30, and a threaded lag 34 with a head 36. Hole 32 is preferably off-center relative to top plate 28 and outer connector member 14 generally, with slot 30 extending into the center of top plate 28. Head 36 is structured and configured such that head 36 can fit through hole 32, but cannot fit through slot 30, while lag 34 slidably fits within slot 30. Rotatable attachment is provided by securing threaded lag 34 in beam B, inserting head 36 into hole 32, and sliding lag 34 into slot 30. Slot 30 is structured and configured so that slot 30, and thus top plate 28 and outer connector member 14, can rotate about lag 34 while upper connector member 14 is attached to beam B by lag 34. Lag 34 alternatively may be permanently, rotatably attached to the center of top plate 28 by conventional hardware. For example, a "captured fastener" (not shown) may be permanently, rotatably mounted in top plate 28 and used in place of lag 34 and rotation slot 30.

Preferably, a plurality of laterally facing openings 38 are included on threaded body 26, and are structured and configured to receive an adjustment tool or lever to aid in rotating outer connector member 14 when lag 34 is rotatably held in slot 30 and threaded body 26 is engaged in threaded socket 16. Openings 38 are longitudinally spaced about threaded body 26 at various distances or intervals, to allow an adjustment tool to be used when varying amounts of threaded body 26 are engaged within threaded socket 16.

Means for fixedly coupling or attaching outer connector member 14 to an external structure or object such as beam B are included with outer coupling member 14, and preferably comprise a plurality of fastening holes 40 in top plate 28 which are structured and configured to accommodate a corresponding plurality of screws 42 or like fastening hardware. The coupling means may be varied as required to accommodate different types of objects which are to be connected to column C. When column C is used to support a beam B made of wood or resin-based material, screws 42 are inserted through holes 40 and engaged into the material of beam B in a conventional manner. When beam B comprises metal, such as an I-beam, holes may be drilled in beam to accommodate screws 42, or alternatively top plate 28 may be welded onto beam B once final positional adjustment has been made.

The adjustable column connector apparatus 10 is used generally to adjustably join the top end of column C to an overhead beam B, while the bottom end of column C is coupled to a base structure (not shown) by conventional means. Note that the adjustable column connector 10 may also be used to adjustably join the bottom end of column C to a base structure beneath column C.

The present invention allows a "draw-down" operation wherein Beam B over column C can be drawn down towards the top of column C. Such a draw down operation, which has heretofore not been possible, allows overhead structures to be correctly positioned on the tops of columns when the columns are installed, and prevents problems, such as drywall cracks, which can subsequently occur due to the settling of an overhead structure down onto a column which was not correctly positioned during installation. The draw down operation using the invention is particularly useful for correction of "sprung" trusses.

In order to use the adjustable column connector 10 to adjustably draw down an overhead structure B, inner support member 12 is coupled to the top end of column C by means of screws 24, which fit through fastening holes 22 in flange 18 and threadedly engage the material of column C. Inner connector member 12 is attached such that threaded socket 16 fits generally within the hollow interior of column C. Threaded body 26 on outer connector member 14 is engaged in threaded socket 16 of inner connector member 12. Lag 34 is attached to beam B at a position which is located generally over the center of the desired position for column C, and column C and attached inner connector member 12 are centrally positioned beneath lag 34. Since threaded body 26 is engaged in threaded socket 16, outer connector member 14 is also centrally positioned beneath lag 34. Column C is positioned so that head 36 of lag 34 can be fitted through hole 32 in top plate 28 of outer connector member 14, and lag 34 is slidably positioned in slot 30 in top plate 28 so that outer connector member 14 is rotatably attached to beam B. By rotating outer connector member 14 relative to inner connector member 12, threaded body 26 is advanced or drawn into threaded socket 16 by the interengaging threading of body 26 and socket 16, causing beam B, which is rotatably attached to outer connector member 14 by lag 34, to be drawn down towards column C. During rotation of outer connector member 14, the rotatably attached beam B will exert a force against outer connector member 14 which resists the draw down operation. Thus, a lever or tool (not shown), such as a conventional screw driver, Allen wrench or metal rod, is inserted into one of the laterally facing holes 38, and force is applied to the tool, which then acts as a lever to aid in rotating outer connector member 14 relative to inner connector member 12. When beam B has been drawn down such that the desired positional relationship of beam B and column C has been achieved, screws 42 are placed in fastening holes 40 and engaged into the material of beam B to fixedly couple outer connector member 14, and thus the attached inner connector member 12 and column C, to the beam B. As noted above, the draw-down operation provided by the invention allows correction of sprung trusses during building construction.

A corresponding "push up" operation may also be carried out with the invention, using generally the same procedure outlined above, with the primary exception being that outer connector member 14 is rotated relative to inner connector member 12 such that threaded body 26 withdraws from threaded socket 16, causing outer connector member 14 to push up on beam B and away from column C. Once beam B has been pushed up into the desired position, screws 42 and fastening holes 40 are used as described above to fixedly attach outer connector member 14, and thus the attached lower connector member 12 and column C, to beam B.

The exact procedure used for installing the adjustable column connector apparatus 10 will generally vary depending upon whether it is used at the top and/or bottom end of column C, whether upward or downward positional adjustment of beam B relative to column C is required, and the distance or amount of working room between the end of column C and beam B. For example, column C and attached inner connector member 12 may first be laterally positioned as required, with lag 34 being subsequently attached to beam B over the center of the positioned column C. Likewise, outer connector member 14 may be rotatably attached to beam B prior to engaging threaded body 26 within threaded socket 16.

The method or process or using the invention will be more fully understood by reference to FIG. 4, which shows a flow diagram outlining generally the steps of the method comprising the invention, as well by reference to FIG. 1 through FIG. 3.

At step 100, an inner connector member 12 and outer connector member 14 are provided. Inner connector member 12 includes an internally threaded socket 16, and outer connector member 14 includes an externally threaded body 26 which is structured and configured to mate with threaded socket 16, as described above.

At step 110, inner connector member 12 is fixedly coupled to column C, preferably by means of screws 24, which fit through fastening holes 22 and engage the material of column C in the manner related above.

At step 120, threaded body 26 of outer connector member is engaged or mated with threaded socket 16 of inner connector member.

At step 130, outer connector member 14 is rotatably attached to beam B. As discussed above, this step is carried out by installing lag 34 in beam B, fitting head 36 of lag 34 through hole 32 in top plate 28 of outer connector member 14, and slidably positioning lag 34 in slot 30 in top plate 28 so that outer connector member 14 is rotatably attached to beam B.

At step 140, column C is positionally adjusted relative to beam B. As described above, by rotating outer connector member 14 relative to inner connector member 12, threaded body 26 is advanced or drawn into threaded socket 16 by the interengaging threading of body 26 and socket 16, causing beam B, which is attached to outer connector member 14 by lag 34, to be drawn down towards column C or pushed away from column C, depending upon the direction of rotation.

At step 150, outer connector member 14 is fixedly coupled to beam B. As related above, when beam B has been drawn down or pushed up such that the desired positional relationship of beam B and column C has been achieved, screws 42 are placed in fastening holes 40 and engaged into the material of beam B to fixedly couple outer connector member 14, and thus the attached inner connector member 12 and column C, to the beam B.

The order of the steps of the method of using the invention should not be considered limiting, and may be varied as required depending upon different situations in which the invention is used. For example, in certain instances it will be desirable to carry out step 130 prior to step 120, by attaching lag 34 to beam B and positioning lag 34 within slot 30 in top plate 28 prior to engaging threaded body 26 into threaded socket 16.

The preferred embodiment of the adjustable connector apparatus 10 as described above is particularly well suited for use with columns made of fiberglass-reinforced resin, such as those made by Dixie-Pacific manufacturing Company of Gadsden, Ala. This type of column is increasingly used in residential construction. Heretofore, fiberglass-reinforced resin columns have been difficult and time consuming to install during construction. The adjustable column connector apparatus 10 and the method of use described above, however, provide a quick, easy and accurate way to position and install fiberglass-reinforced resin columns. The invention as described above can also be used with conventional stock wood columns. The present invention can additionally be used with metal columns such as FYPON® columns, wherein a galvanized pipe is embedded within a polymeric resin which has been decoratively shaped.

The aforementioned types of conventional columns typically include a hollow interior which can accommodate threaded socket 16 on inner connector member 12. The invention, however, may also be used with columns having a solid interior by creating a suitable opening in the end of the column to accommodate threaded socket 16. The threaded socket 16 and threaded body 26, however, can be interchanged such that threaded body 26 is included on inner connector member 12 and threaded socket 16 is included on outer connector member 14. In this manner, a hollow column would not be required, and a hole or opening in beam B would be created to accommodate threaded socket 16. This particular arrangement for the threaded positional adjustment means of the invention is particularly desirable for use with stone or marble columns which are not hollow and cannot readily be machined to create a bore or opening to accommodate threaded socket 16. However, since the columns typically used in construction have a hollow interior to accommodate threaded socket 16, the generally preferred embodiment of the invention will include the threaded socket 16 on the inner connector member 12 and the threaded body 26 on the outer connector member 14, as described above.

Since the adjustable column connector apparatus 10 comprising the invention will often be subjected to substantial loads during use, all portions of the apparatus 10 are preferably fabricated from steel or other high strength metal alloy. However, parts or all of the apparatus 10 may be made of other materials, such as reinforced resin composites, in cases where large loads are not placed on the apparatus 10.

Accordingly, it will be seen that this invention provides an adjustable column connector apparatus which allows quick, easy and accurately adjustable attachment of columns to adjacent structures. Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A column connector apparatus, comprising:

(a) an inner connector member, said inner connector member including means for fixedly coupling to a column;

(b) an outer connector member, said outer connector member including a top plate, said outer connector member including means for fixedly coupling to an external structure, said outer connector member including means for rotatably attaching to said external structure, said rotatably attaching means comprising a slotted opening in said top plate, said rotatably attaching means comprising a lag, said slotted opening structured and configured to rotatably receive said lag; and (c) said inner connector member including threaded means for drawing down said external structure towards said column, said threaded drawing down means comprising a threaded socket coupled to said inner connector member and a threaded body coupled to said top plate of said outer connector member, said threaded body structured and configured to engage said threaded socket.

2. A column connector apparatus, comprising:

(a) an inner connector member;

(b) an outer connector member, said outer connector member including a top plate;

(c) a threaded socket joined to said inner connector member;

(d) a threaded body joined to said outer connector member, said threaded body coupled to said top plate, said threaded body structured and configured to threadably engage said threaded socket;

(e) means for joining said inner connecting member to a column;

(f) first coupling means for rotatably attaching said outer connector member to an external structure, said first coupling means comprising a rotation slot and a hole in said top plate, said rotation slot centrally positioned in said top plate, said hole communicating with said rotation slot; and (g) second coupling means for fixedly attaching said outer connector member to said external structure.

3. A column connector apparatus as recited in claim 2, wherein said inner connector member further comprises a flange, said threaded socket coupled to said flange.

4. A column connector apparatus as recited in claim 2, further comprising a plurality of laterally facing openings on said threaded body.

5. A column connector apparatus as recited in claim 2, wherein said first coupling means further comprises a lag, said rotation slot structured and configured to rotatably receive said lag.

6. A column connector apparatus as recited in claim 3, further comprising a plurality of reinforcing gussets on said inner connector member, said gussets joined to said flange, said gussets joined to said threaded socket.

7. A method for joining a column to an object, comprising the steps of:

(a) providing an inner connector member, said inner connector member including a threaded socket; and (b) providing an outer connector member, said outer connector member including a threaded body, said outer connector body including a top plate, said top plate including a hole, said top plate including a slot, said slot communicating with said hole, said threaded body structured and configured to threadably engage said threaded socket;

(c) coupling said inner connector member to said column;

(d) engaging said threaded body in said threaded socket;

(e) coupling a lag to said object;

(f) positioning said lag within said slot in said top plate to rotatably attach said outer connector member to said object; and (f) positionally adjusting said column and said object by rotating said outer connector member relative to said inner connector member.

8. A method for joining a column to an object as recited in claim 7, wherein said positional adjustment step is carried out by rotating said threaded body within said threaded socket and pushing said object up relative to said column.

9. A method for joining a column to an object as recited in claim 7, wherein said positional adjustment step is carried out by rotating said threaded body within said threaded socket and drawing said object down towards said column.

* * * * *